US006482239B1

(12) United States Patent
Jones et al.

(10) Patent No.: US 6,482,239 B1
(45) Date of Patent: Nov. 19, 2002

(54) SOUND POST INSTALLER

(76) Inventors: Clarence G. Jones, 8215 Highland Dr., Covington, GA (US) 30014; Suzanne Passarella, 8215 Highland Dr., Covington, GA (US) 30014

( * ) Notice: Subject to any disclaimer, the term of this patent is extended or adjusted under 35 U.S.C. 154(b) by 0 days.

(21) Appl. No.: 09/820,532

(22) Filed: Mar. 29, 2001

Related U.S. Application Data

(60) Provisional application No. 60/219,414, filed on Jul. 20, 2000.

(51) Int. Cl.[7] ..... G10G 7/00

(52) U.S. Cl. ..... 821/458; 84/453; 84/277; 84/274

(58) Field of Search ..... 84/458, 453, 277, 84/274

(56) References Cited

U.S. PATENT DOCUMENTS

| | | | | | |
|---|---|---|---|---|---|
| 152,934 | A | * | 7/1874 | White | 7/164 |
| 455,822 | A | * | 7/1891 | Weber | 7/127 |
| 1,164,255 | A | * | 12/1915 | Brown | 84/278 |
| 1,466,681 | A | | 9/1923 | Todd | 84/277 |
| 1,556,340 | A | | 10/1925 | Myers | 84/277 |
| 1,559,657 | A | * | 11/1925 | Todd | 84/277 |
| 2,522,190 | A | | 12/1950 | Mouser | 81/65 |
| 3,706,106 | A | * | 12/1972 | Leopoldi | 7/158 |
| 5,804,748 | A | | 9/1998 | Clayton, Sr. | 84/458 |
| 6,196,121 | B1 | * | 3/2001 | Crowl | 99/421 A |
| 6,231,018 | B1 | * | 5/2001 | Barbieri | 248/302 |

OTHER PUBLICATIONS

Catalog No. 75 p. 56 Oct. 15, 1993 Stringed Instrument Making & Repair Supplies.

* cited by examiner

*Primary Examiner*—Shih-Yung Hsieh
(74) *Attorney, Agent, or Firm*—Kim S. Manson

(57) ABSTRACT

The present invention, in a preferred embodiment, is a new and improved sound post installer that generally comprises a handle, a prong and a positioning hook. More specifically, the handle is an elongated rodlike member that is sized so that it may be easily inserted into the F hole and turned within the F hole with ease. The handle is angled at one end to produce an offset in an otherwise straight member. The prong is a razor sharp pointed member located at end of the offset. The positioning hook is located at the other end of the handle. The positioning hook may be placed anywhere along the length of the installed sound post to adjust the vertical positioning of the sound post. A flexible sleeve is fixedly attached to the positioning hook to allow the user to rotate the sound post to maximize contact with belly and back of the instrument. As an alternative, a plurality of notches are located on the hook to allow rotation of the sound post.

8 Claims, 3 Drawing Sheets

SOUND POST INSTALLER

This application is entitled to the benefit of Provisional Patent Application Ser. No. 60/219,414 filed Jul. 20, 2000.

TECHNICAL FIELD

The present invention relates generally to musical instruments and, more specifically, to a sound post installer for violins and violas.

BACKGROUND ART

Violins, violas and other wooden string instruments are expensive, delicate and often works of art. Many violins and violas are very rare, especially instruments such as Stradavari and Amati, and often irreplaceable. When such instruments require repair they must be handled with extreme care. This also applies to instruments that are not very rare due to the expense of such instruments.

The violin and viola typically comprise a soundbox, a neck, tuning pegs and four strings stretched over a bridge near the center of the soundbox. The top and bottom of the soundbox, called the belly and the back, respectively, are connected around their perimeter by a sidewall. When the strings are vibrated by plucking or by drawing a bow over them, the strings induce a vibrational energy through the bridge to the belly and the back of the instrument. The soundbox amplifies the vibration and produces the distinctive sounds of the violin and viola. A sound post is a thin column, typically made of pine, that is wedged between the belly and the back. The sound post must be properly set in order to obtain the richness of sound from the instrument.

The proper placement of a sound post is a difficult and tedious operation. The sound post is angled at its bottom and top to match the angle of the belly and the back. In order to replace a sound post, it must be passed diagonally through a narrow F hole located in the belly of the instrument, turned vertically and wedged into place so that it properly transmits sound. The sound post must then be rotated so that the angle of sound post meets the angles of the belly and the back.

Presently, sound posts may be installed with a wrench-type tool which usually requires the sound post to be placed in a cradle or loop. Examples of such devices may be found by reference to U.S. Pat. No. 5,804,748 to Clayton, U.S. Pat. No. 2,522,190 to Mouser and U.S. Pat. No. 1,556,340 to Myers. Although these devices allow a sound post to be maneuvered through the F hole, they do not provide the control necessary to tightly wedge the sound post nor enough control to turn the sound post so that it meets the angles of the belly and the back. Also, if a sound post is installed and further adjustments are required, it is impossible to get the cradle or the loop back onto the installed sound post in order to turn it or adjust its vertical position.

Pliers have also been proposed to install sound posts. One such example may be found by reference to U.S. Pat. No. 1,466,681 to Todd. The Todd pliers also require the sound post to be placed in a cradle. Although the pliers provide a firm grasp on the sound post, maneuverability is limited because the pliers are too wide to reach far enough into the F hole. As is the case with cradle or loop wrenches, the pliers are difficult to reposition back onto the sound post once removed from the violin because of the bulkiness of the pliers.

The risk of damage to the violin or viola is a very real concern since most instruments, whether rare or not, are expensive. The use of bulky pliers, cradle devices and loop devices often results in scratching or gouging the instrument because they are too big to effectively maneuver once the device is inside the instrument. Further, current prior art does not provide cushioning or padding to prevent damage to the instrument.

It is readily apparent that a new and improved sound post installer is needed that is easy to use, that allows the sound post to be turned or repositioned once installed in the soundbox and that prevents damage to the musical instrument during repairs. It is, therefore, to the provision of such an improvement that the present invention is directed.

BRIEF SUMMARY OF THE INVENTION

Briefly described, in a preferred embodiment, the present invention overcomes the above-mentioned disadvantages by providing a streamlined sound post installer that allows the sound post to be easily inserted and easily adjusted to the proper position within the violin or viola. Generally, the present invention, in the preferred embodiment, comprises a handle, a prong and a positioning hook.

More specifically, the handle is an elongated rodlike member that is sized so that it may be easily inserted into the F hole and turned within the soundbox with ease. The handle is angled at one end to produce an offset in an otherwise straight member. The prong is a pointed razor sharp member located at the end of the offset. The positioning hook is located at the other end of the handle. The positioning hook may be placed anywhere along the length of the installed sound post to adjust the vertical positioning of the sound post. In order to enhance the ability to rotate the sound post installer once it is installed within the instrument, a flexible sleeve is provided to cover the positioning hook so as to firmly grab and hold the sound post as it is being rotated.

Further, the sound post installer comprises a cushion along the handle. The cushion serves to protects the musical instrument from scratches and other potential damage that can be caused when maneuvering the sound post into and out of the instrument. The cushion also provides additional grip and control for the user.

In an alternate embodiment, alternate rotational means is provided via a plurality of notches located along the interior angle of the positioning hook. As the sound post installer is turned, the notches firmly grab the sound post thereby providing the grip necessary to allow the sound post to be rotated.

A feature and advantage of the present invention is to provide a new and improved sound post installer that allows a sound post to be inserted into the instrument with ease.

Another feature and advantage of the present invention is to provide a new and improved sound post installer that allows a sound post to be vertically repositioned without removing the sound post from the instrument.

A further feature and advantage of the present invention is to provide a new and improved sound post installer that allows the sound post to be rotated so that maximum contact is made between the sound post and the belly and back of the musical instrument to increase richness of musical sound.

Yet another feature and advantage of the present invention is to provide a new and improved sound post installer that can be easily used by an inexperienced user.

A further feature and advantage of the present invention is to provide a new and improved sound post installer which may be produced at a low cost of manufacture with regard to materials and labor, thereby making the sound post installer economically available to the buying public.

These and other objects, features and advantages of the invention will become more apparent to one skilled in the art from the following description and claims when read in light of the accompanying drawings.

DETAILED DESCRIPTION OF THE PREFERRED EMBODIMENT

In describing the preferred embodiment of the present invention as illustrated in the figures, specific terminology is employed for the sake of clarity. The invention, however, is not intended to be limited to the specific terminology so selected, and it is to be understood that each specific element includes all technical equivalents that operate in a similar manner to accomplish similar functions.

With regard to all such embodiments as may be herein described and contemplated, it will be appreciated that optional features, including, but not limited to, aesthetically pleasing coloration and surface design, and labeling and brand marking, may be provided in association with the present invention, all without departing from the scope of the invention.

Figure 1:
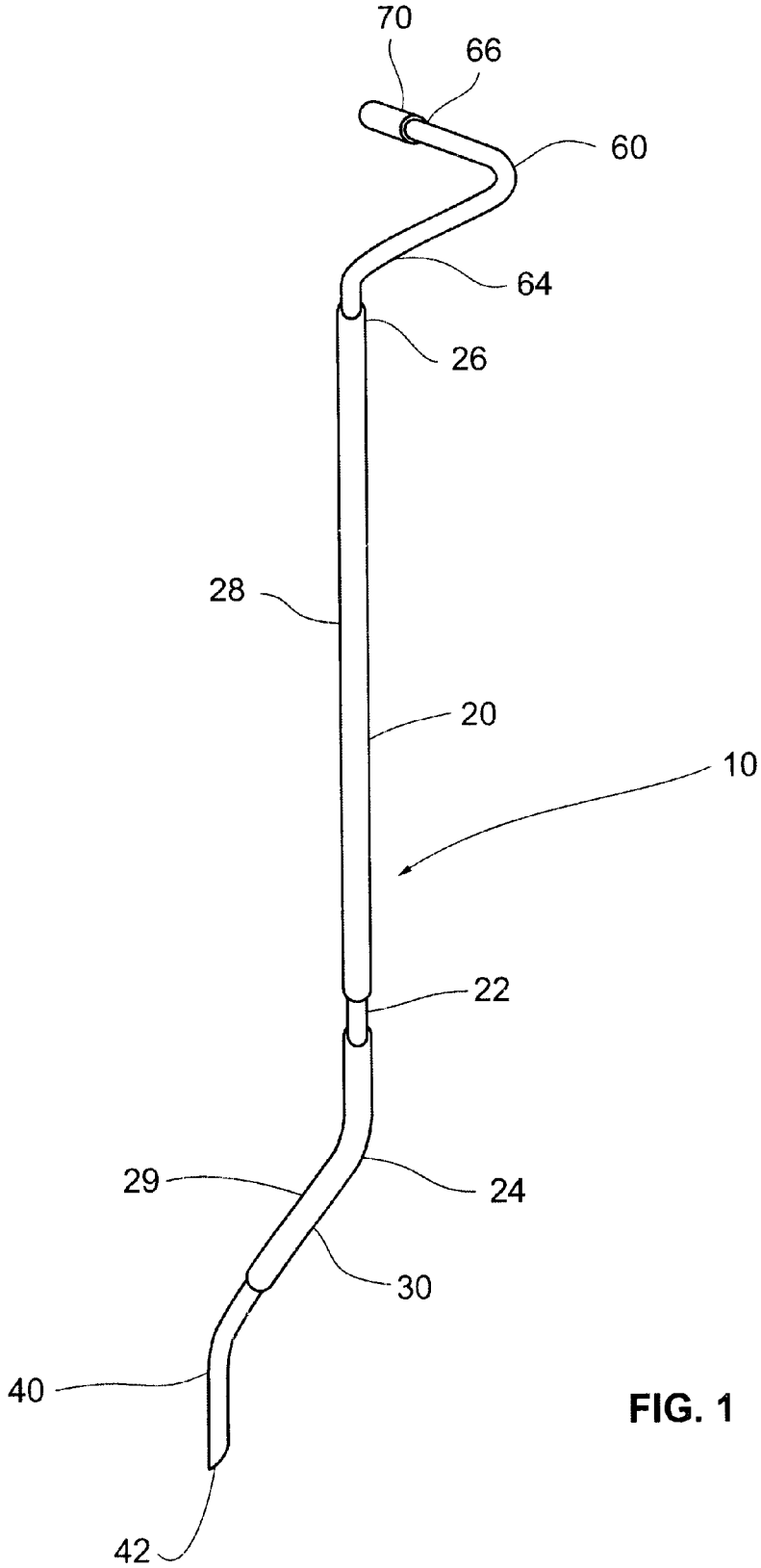
FIG. 1 is a perspective view of the present invention according to a preferred embodiment.
Figure 2:
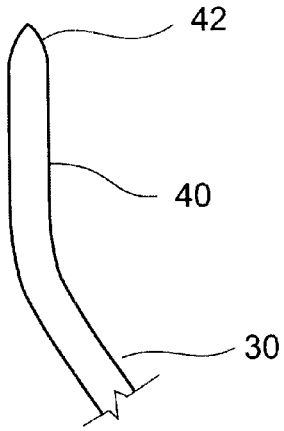
FIG. 2 is a perspective view of the prong of the present invention according to a preferred embodiment.
Figure 3:
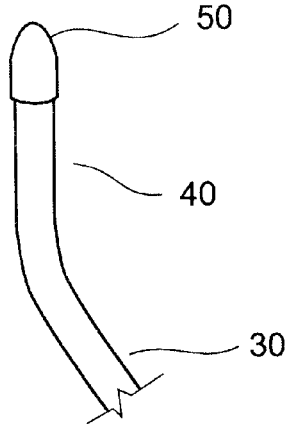
FIG. 3 is a side elevational view of the prong of the present invention according to a preferred embodiment.

Referring now to FIGS. 1 through 3, sound post installer 10 generally comprises a handle 20, a prong 40 and a positioning hook 60. More specifically, handle 20 comprises an elongated rodlike member 22 having first end 24 and second end 26. Handle 20 is dimensioned to easily fit and be turned within the limited dimensions of the F hole of a violin or viola. First end 24 of handle 20 is angled to produce offset 30 for prong 40, so that prong 40 is in same horizontal direction as handle 20. As shown in FIG. 2 and FIG. 3, prong 40 comprises a pointed razor sharp member 42 located at end of offset 30. Cap 50 is provided to protect user from injury from prong 40.

Figure 4:
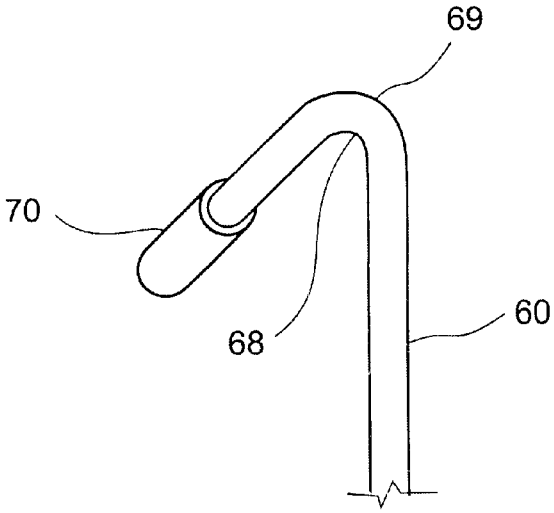
FIG. 4 is a perspective view of the positioning hook of the present invention according to an preferred embodiment.

Positioning hook 60 comprises first end 64 and second end 66, interior surface 68 and exterior surface 69. First end 64 of positioning hook 60 is fixedly attached to second end 26 of handle 20. As shown in FIG. 4, flexible sleeve 70 is fixedly attached to second end 64 of positioning hook 60 so as to provide rotational means to adjust position of sound post when placed within instrument. Referring again to FIG. 1, positioning hook 60 is located on one side of handle 20 and prong 40 and offset 30 are located on the opposite side of handle 20.

Sound post installer further comprises cushion 28 along handle 20 and cushion 29 along offset 30 to protect instrument from scratches and other damage potentially caused by sound post installer. Handle 20, prong 40 and positioning hook 60 preferably comprise solid metal rod but may comprise plastic, wood or any rigid deformable material.

Figure 5:
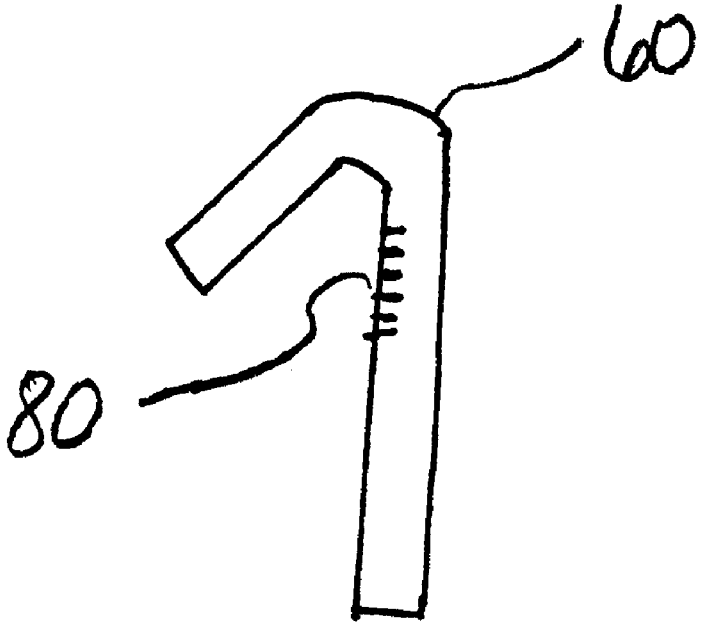
FIG. 5 is a perspective view of the positioning hook of the present invention according to an alternative embodiment.

An alternate embodiment, as shown in FIG. 5, comprises a plurality of notches 80 are placed along interior surface 68 at first end 64 of positioning hook 60 to grasp and hold sound post for rotation. Notches 80 are angled so that positioning hook 60 may be gently embedded into sound post to allow the user to control the degree of rotation.

In use, prong 40 is inserted into sound post at any chosen point along longitudinal length of the sound post. Sound post installer is held along handle 20 to insert sound post into F hole. Sound post is firmly wedged into chosen location within soundbox of the violin or viola. Prong 40 is removed from sound post. If vertical adjustment is required, positioning hook 60 is placed onto installed sound post to reposition top or bottom of sound post as needed. If the sound post must be repositioned, the sound post is placed between interior surface 68 of positioning hook 60 and flexible sleeve 70 is used to rotate sound post to maximize contact with curvature of belly and back of instrument. Alternatively, the sound post is placed between interior surface 68 of positioning hook 60 and notches 80 grab and hold sound post to facilitate rotation.

Having thus described exemplary embodiments of the present invention, it should be noted by those skilled in the art that the within disclosures are exemplary only, and that various other alternatives, adaptations, and modifications may be made within the scope of the present invention. Accordingly, the present invention is not limited to the specific embodiments illustrated herein, but is limited only by the following claims.

What is claimed is:

1. A device for installing a sound post in a musical instrument comprising:

a handle having a first end and a second end, said first end of said handle is angled to produce an offset in said handle;

a prong fixedly attached to said first end of said handle;

a hook having a first end and a second end, said first end of said hook is fixedly attached to said second end of said handle; and a flexible sleeve fixedly attached to said hook.

2. The device as recited in claim 1 wherein said prong further comprises a pointed razor sharp end.

3. The device as recited in claim 2 further comprising a protective covering for said prong.

4. The device as recited in claim 2 further comprising a cushion about said handle and said offset.

5. A device for installing a sound post in a musical instrument comprising a handle having a first end and a second end, said first end of said handle is angled to produce an offset in said handle; a prong fixedly attached to said first end of said handle; a hook having a first end and a second end, said first end of said hook is fixedly attached to said second end of said handle; and a plurality of notches in said hook proximal to said second end of said handle.

6. The device as recited in claim 5 wherein said prong further comprises a pointed razor sharp end.

7. The device as recited in claim 6 further comprising a protective covering for said prong.

8. The device as recited in claim 6 further comprising a cushion about said handle and said offset.

* * * * *